US006647639B1

(12) United States Patent
Storrer

(10) Patent No.: US 6,647,639 B1
(45) Date of Patent: Nov. 18, 2003

(54) MOISTURE REMOVAL SYSTEM

(75) Inventor: Ernest J. Storrer, Kirkland, WA (US)

(73) Assignee: Injectidry Systems Inc., Redmond, WA (US)

( * ) Notice: Subject to any disclaimer, the term of this patent is extended or adjusted under 35 U.S.C. 154(b) by 0 days.

(21) Appl. No.: 09/516,827

(22) Filed: Mar. 1, 2000

Related U.S. Application Data

(60) Provisional application No. 60/123,401, filed on Mar. 8, 1999.

(51) Int. Cl.[7] ..... F26B 25/00

(52) U.S. Cl. ..... 34/104; 34/443

(58) Field of Search ..... 34/87, 103, 104, 34/443, 487, 439, 507; 239/282, 283; 285/110, 140.1

(56) References Cited

U.S. PATENT DOCUMENTS

| | | | | | |
|---|---|---|---|---|---|
| 1,703,551 | A | | 2/1929 | Singer | |
| 2,623,364 | A | | 12/1952 | Munters | |
| 2,758,390 | A | | 8/1956 | Munters | |
| 3,115,567 | A | | 12/1963 | Meltzer | |
| 3,805,405 | A | | 4/1974 | Ambos | |
| 4,391,619 | A | | 7/1983 | Shono et al. | |
| 4,571,849 | A | | 2/1986 | Gardner et al. | |
| 5,408,759 | A | | 4/1995 | Bass | |
| 5,466,015 | A | * | 11/1995 | Berenter | 285/158 |
| 5,555,643 | A | | 9/1996 | Guasch | |
| 5,590,478 | A | * | 1/1997 | Furness | 34/437 |
| 5,761,827 | A | * | 6/1998 | Gausch | 34/413 |
| 5,893,216 | A | | 4/1999 | Smith et al. | |
| 5,960,556 | A | * | 10/1999 | Jansen | 34/402 |
| 6,457,258 | B1 | * | 10/2002 | Cressy et al. | 34/443 |

* cited by examiner

*Primary Examiner*—Henry Bennett
*Assistant Examiner*—Andrea M. Ragonese
(74) *Attorney, Agent, or Firm*—Black Lowe & Graham, PLLC

(57) ABSTRACT

The invention provides an improved method of drying wet or water damaged structures. Specifically, several improved features of a forced air system are provided.

13 Claims, 7 Drawing Sheets

MOISTURE REMOVAL SYSTEM

CLAIM OF PRIORITY

This application claims priority pursuant to 35 U.S.C. §119(e) from Provisional Application Serial No. 60/123,401 filed Mar. 8, 1999.

FIELD OF THE INVENTION

The present invention relates to sytems and devices for removing unwanted and harmful moisture from wet and/or water damaged structures.

BACKGROUND OF THE INVENTION

Unwanted water, introduced by flooding, precipitation or otherwise, causes millions, if not billions, of dollars of damage to structures every year. Generally, the amount of damage can be reduced, minimized, or even eliminated if the water can be removed from the structure shortly after its undesired entry into the structure. For example, if the water can be extracted promptly in some manner from the structure generally, and then from the cavities within walls, floors and other structural elements, then rot, mold, rust and other destructive effects of the unwanted water can be minimized or avoided altogether.

Some early attempts to solve this problem involved simply passive drying, such as draining the visible water, and opening windows to let the hidden moisture evaporate. While this had the advantage of being relatively non-intrusive and nondestructive, it also generally took so long that it did not avert rot, mold, rust and the other destructive effects of the lingering moisture. Also, it left the structure relatively unusable for an undesirably long period of time.

Partly in response to those disadvantages, more active approaches were used, such as forcing air, heated or otherwise, through the afflicted structure so as to expedite the evaporation process. While this resulted in some improvement in many cases, generally, the results were still not satisfactory.

Other early attempts involved removal of some or all of certain structural elements to facilitate evaporation from enclosed areas. For example, in some cases floorboards or wallboards were removed to enable the moisture trapped in the wall or floor cavities to evaporate more effectively and sooner. The obvious disadvantage of such approaches is that they were so destructive as to require significant repair and/or replacement of the structure after the drying process, resulting in greater cost and often the loss of use of the structure for a longer period of time than would be the case without the destruction.

To overcome some of the disadvantages of the prior systems, some improved systems were developed. For example, in my prior patent application (application Ser. No. 08/890,141, filed Jul. 9, 1997 now pending,) I developed certain features of a system that dried structures more effectively and less destructively than previous systems. In that system, a blower forced air, either positively or negatively, to dry the afflicted structure. Specifically, in positive pressure mode, the blower would blow dry air through a hose, and into one or more manifolds, and then from the manifolds into a network of smaller tubes, and then into an injector that penetrated through a small hole in the structure. Conversely, when in negative pressure mode, the system would suck the damp air from the structure, out through the hole via the injector, and then through the tubes, the manifold, the hose, and ultimately out back through the blower.

While this system was a significant advance over prior systems, significant problems remained. Some shortcomings of my prior system, and other prior systems, included:

(1) Excessively destructive intrusion. Specifically, the prior system required that a plurality of relatively large sized holes be created in the structure. For example, in a high density material such as wood, a hole of 7/16" diameter would be required. Holes this large require more effort in repair than would be required with smaller holes. While some prior systems have attempted to utilize smaller holes, the required air injectors were so small that they lacked convenient and effective means for preventing accidental withdrawal without damage to the structure. For example, when an injector was inserted into a wet sheetrock ceiling, the injector would have a tendency to fall out, especially in positive pressure mode. To date, previous attempts to prevent this problem have either not been effective, or have had undesirable side-effects, such as larger holes to accommodate fletching for friction to prevent withdrawal, angled penetration tending to cause damage upon removal, and threads for screwing in the injectors tending to cause a suboptimal amount of labor in the field.

(2) Clogging. In my prior system, the injectors included a small hole near the distal end of the injector tube. The purpose of this extra hole was in part to create extra airflow. However, the hole in the distal end was too close to the end of the injectory and thereby resulted in frequent clogging with wet drywall or other debris or matter within the wall or floor cavity. Because of the small surface area available, it could not be large enough as a single set of holes.

(3) Inefficiency and Expense in Mobilization and Demobilization. Perhaps the biggest problem with prior systems was the relatively large amount of labor required to assemble, reconfigure and disassemble them in the field. Since labor costs for restoration services are relatively high, even modest improvements in field efficiency can be extremely valuable.

(4) Interference with Facilities & Operations. Another disadvantage of my prior system, and all other drying systems of which I am aware, is the signficant intrusion and interference with the structure being dried. That is, as a practical matter, while prior systems are being used to dry a structure, it is nearly impossible for the usual occupants of the premises being dried to conduct business therein. For example, in an office building, the office tenants must generally not return until the job is completed due to the extensive tangle of blowers, hoses and tubes radiating in all directions throughout the afflicted structure. In most prior systems also, the blowers are too loud to enable work in the structure until the job is completed.

(5) Inefficient air flow. Prior systems moved air inefficiently. Specifically, for example, in my prior system while in positive mode, dry air would be forced several feet down a trunk hose, and then into a manifold. From the manifold, some of the air would be dispersed into a tube which retraced back over the same distance to a hole in the structure close to the blower. This inefficiency was an inherent feature of the general configuration of our prior system, in that a main trunk line hose would transmit the air to a manifold, typically in the center of a room or wet area, and the manifold would then disperse the air through tubes all about the room. Thus, all other things being equal, higher pressure would be required to overcome the friction inherent in the system. Or, conversely, given a maximum amount of pressure sustainable by the blower in the system, the friction in the inefficient distribution of the prior systems would leave that much less effective air movement for actual drying at the point of the wet surface.

(6) Waste of Material. For much the same reason, the prior systems waste a considerable amount of material. Specifically, much more hosing and tubing is required than is with the present invention. This not only creates more manufacturing cost and labor in the field, but also tends to clutter the afflicted structure to the point of presenting a hazardous condition for occupants, such as by increased risk of tripping.

Special Difficulties with Hardwood Floors

Each of the foregoing difficulties with prior systems applied to drying any part of any structure in general, whether walls, ceilings, cabinets, or floors, or any cavities therein. However, particular difficulties are presented with hardwood floors. Hardwood floors, when damaged by excess moisture, can be very difficult to dry. Most homeowners, for example, are completely discouraged to see their floors commence to swell and cup, especially since such damage can occur after the floors only had water on them for as few as 20 minutes. In such cases, with current systems, the owner's alternatives are not good.

One option is total replacement If the area damaged is a large percentage of the entire hardwood area, and the cupping heavy, the option of complete replacement may currently be most appropriate. The full replacement is usually easy for the contractor to bid, with wet material removal and replacement fairly straightforward. However, unless the contractor is careful and accustomed to repairing water damaged structures, hardwoods are sometimes re-installed over damp subfloors. Extreme care must be taken to equalize the structure and the new hardwood prior to installation. In addition, total replacement is generally very costly. Another disadvantage is the total time the average home or office is unusable or substantially unusable. The average drying time even with equipment is 1–2 weeks just to dry the subfloor. This delay dramatically increases the total cost of the loss by reason of additional living expenses or loss of use.

A second option is partial replacement. Again however, the substrate must be dried to equilibrium, and the total repair time is close to that of complete replacement. A further disadvantage is that sometimes the wood cannot be matched to the owner's satisfaction.

Many restoration contractors attempt to dry hardwoods by one or a combination of the following: blowing air across the surface, dehumidifying (or tenting & pumping in dehumidified air), or blowing dry air from the wall area. The first option of blowing air across the surface does almost no good. The finishes and sealers prevent the moisture from being released easily. Dehumidifying accompanied by tenting seems good on the face but seldom works adequately and often causes the wood to check and crack.

Thus, it is an object of the present invention to also provide an improved and yet simple and inexpensive drying system particularly effective at drying hardwood and other similar floors.

SUMMARY OF THE INVENTION

The present invention provides an improved system for removing excess moisture from a structure. In accordance with the invention, several of the problems with prior systems are solved, and additional improvements are added. In addition, the present invention provides an improved system for removing excess moisture from hardwood and similar floors.

In accordance with the invention, several improvements are made to prior air distribution and collection systems. As with prior systems, a blower is provided to force air through a main trunk line hose. The main hose may terminate, or may return to the blower in a complete circuit. Also, as with prior systems, the invention may be operated in either positive or negative pressure mode (that is, it may either blow dry air into the structure, or suck wet air out of the structure through the air distribution network).

The manner of distribution of the air however, is completely new and improved in several respects. First, much smaller penetration holes can be used with the improved injectors. The new injectors are smaller than in previous systems, and yet have means for preventing accidental withdrawal. Specifically, each injector has locking tabs which can be depressed by the fingers of the user to reduce the effective diameter of the injector to facilitate insertion of the injector into the small hole. Once the injector is inserted however, the tabs can be released, and they will spring back into place, creating an effective diameter that is wider than the hole into which the injector was inserted, thereby preventing accidental withdrawal of the injector. This feature is particularly helpful in positive pressure mode, when the mere force of the air emanating from the injector will tend to dislodge the injector from the hole. It is also particularly helpful when drying ceilings, where the force of gravity tends to pull the injector out of the hole. This locking tab mechanism can also be easily removed without any damage to even fragile structures simply by re-pressing the tabs, and pulling.

The locking tab mechanism is a significant improvement over the prior systems, some of which relied either on fletchings or threads and friction (which required a larger injector diameter and hence a larger penetration hole and tended to result in damage around the edge of the hole in any case), and others of which lacked the friction fletchings and the larger hole, and were of small diameter, but which were not effective in preventing accidental withdrawal. Also, the locking tab mechanism makes it extremely easy to quickly and install and remove the injectors with zero damage to the structure other than the very small hole. The locking tab mechanism is not only much easier to use than the threaded or fletched injectors, but causes less damage. In the preferred embodiment a pair of opposing locking tabs are utilized, but either one or any number of tabs may be used in accordance with the invention.

Another aspect of the invention is the improved means for preventing clogging of the injector. My prior system provided an injector with a hole at the distal end, and another hole near the distal end to create Bernoulli effect. While this arrangement had advantages over prior systems, it also had practical disadvantages. Specifically, it had a tendency to clog, especially when drying sheetrock enclosed cavitities, or other structural cavities with debris therein. It accordance with the invention, the small hole near the distal end is replaced with one or more elongated slots resulting in greater alternate air source. Thus, if the hole at the end of the injector becomes plugged or clogged, the air may still be drawn in through the slot. Similarly, the slots are themselves less likely to become plugged than the small hole of prior systems. In prior systems, the hole was designed primarily for creating Bernoulli effect, and not for air removal as such, and for that reason was quite small. In the present invention, the slots serve a different purpose, and result in a more effective injector in practice, especially in negative pressure mode. In addition, even the small gaps surrounding the locking tab mechanism also serve to enable further air movement if the slots or end-hole become plugged or clogged.

The new injectors also provide a double barb near the proximal end. This double barb arrangement enables the injector to be used as a connector instead of an injector when desired. For example, in many uses, 2 individual air outlets need to be joined together to stop air escaping if not needed in the drying process. Instead of taking both injectors out and substituting a ⅜x⅜ connector, one injector can be removed and the second injector left in place and used as a connector of the unused lines. If operator desires to extend the length of the tubing, the injector may be left in place and another tube with injector attached, thereby lengthening the tube to get air where needed. Thus, the system is more versatile and convenient in use, because the injectors are configured to serve two functions, and a separate part (i.e., a connector) is not required.

A third fundamental aspect of the invention is the means for improved efficiency in mobilization and demobilization. Specifically, the configuration of the new system is considerably less cluttered, takes less time to assemble, deploy, reconfigure and disassemble.

Prior systems involved a trunk line hose feeding a manifold, which in turn distributed the air through a plurality of long tubes (see FIG. 1). The system of the invention instead distributes the tubes along the trunk line hose (see FIG. 2). As a result, considerably less tubing is required, and no manifold is required at all, resulting in lower manufacturing costs and a less expensive overall system for the user.

In addition, in a preferred embodiment of the new system, the tubes are preassembled, that is already attached in the trunk hose. Thus, the user need not even affix any of the tubes to a manifold. This feature, plus the generally less cluttered configuration as shown in FIG. 2 relative to FIG. 1, results in a much easier system to use in the field.

In addition, the new configuration results in less interference with the afflicted structure. The shorter tubes being affixed along the trunk enable the system to be deployed in most applications around the perimeter of the afflicted room, leaving most of the room available for use.

The new configuration also distributes the air more efficiently in the sense of requiring less energy (typically electrical) and less tubing material per unit of air moved. By delivering air at the point of need, there is an elimination of tubing, eliminating need for air to travel through 3–4 unnecessary feet of tubing for each injector, faster setup, less trip hazard, less labor to carry in and setup. Thus, in summary, presently the drying art practiced has manifolds which are placed at infrequent intervals disposed along a trunkline. The disadvantages are in the area of messiness, excessive amounts of tubing required, trip hazard, increased friction due to extra lengths of tubing required and high labor costs to setup. The present invention solves each of these problems.

The new configuration could not be effected simply by multiplying the number of manifolds of the prior systems, in part because the labor and material costs would be prohibitive. Instead, a fundamentally new approach was required. Specifically, the distribution of the air more efficiently to the afflicted areas, without doubling back, required a fundamentally different configuration. The configuration of the present invention provided that fundamental difference. Specifically, it involved tubing along the main trunk hose. However, this configuration had to be accomplished in a manner that would retain the integrity of the main trunk hose, and was inexpensive and easy to use.

In accordance with the invention, the new system provides an active hoseline, by providing self-piercing scooped hose inserts. The scooped hose inserts penetrate the main hoseline at regular intervals (typically every 8 inches, for reasons explained below). The inserts are self-piercing, such that they can be inserted into the main hose simply by pushing them in by hand. This provides maximum versatility to the user in the field. The inserts further provide an air scoop, configured and oriented so as to catch the air passing through the hoseline in positive pressure mode, and efficiently inserting the air into the hoseline in negative pressure mode. The inserts further provide a barbed nozzle end for easily affixing the tubes.

Thus, in general, the self-piercing, self-sealing scooped hose inserts accomplish the function of distributing appropriate amounts of air from and to the main hoseline to the wet structure more directly, less expensively, and more efficiently than the manifold configuration of the prior systems. Less labor, less material, and less energy are required. In fact, the need for manifolds is completely eliminated. (Although a manifold can still be utilized when desired).

The insert is further unique in that it is capable of piercing a hose and self sealing with flanges on each side of the hose wall. On the proximal end there is a barbed opening for coupling a tube to it and the outer flange is curved to accommodate the outside surface of the hose. This results in the flange being flat at all points eliminating rocking which could potentially pull insert out of hose. There is one or more pins on the hose side of the outer flange which fit between the ribs on the outside surface of the hose. This eliminates rotation of the insert keeping the insert secure. The inside flange is introduced through the hose wall and seals on the inside. An adhesivesealant may be used to seal any small cracks between the shaft that penetrates the hose and the hose, but in most applications such sealant may not be required. The shaft is hollow and conducts air from the inside of the hose to the outside or the reverse if used negatively. The bottom of the insert is pointed with gradually tapering sides to allow the insert to be pushed through the hose. In this cone area, there is a scoop which points toward air source or toward the vacuum source if used negatively. This scoop is designed to re-direct air while minimizing friction. The scoop is connected to the hollow shaft and communicates with the distal end of the insert.

Hardwood Floors

The present invention also provides an improved system for drying floors, and especially hardwood floors. In accordance with the invention, the system contains one or more plates for use with a grid. The plates are designed to go on top of the grid after the floor is prepared. The system, in a preferred embodiment are best used in areas of approximately 50 square feet.

In accordance with the invention, each wet area may be taped off separately and a separate plate used in each area. The system may be installed to avoid the potential floor traffic and minimize trip hazards. For example, it is usually best to put the plates on the sides of a hall next to a wall. In a bathroom, you would not set up a plate in front of the wash basin or commode, but probably along a wall out of the way. An effort should be made to cover the bulk of the wet area. In many cases however, the effect of the vacuum will extend beyond the reach of the area covered with grid and plastic sheeting. These areas might be the area beneath the stove and refrigerator. Once the vacuum is turned on, there is a pulling effect that will exert force beyond the grid.

In accordance with the invention, the wet floor surface is prepared. Generally, this involves some sanding or other treatment to remove or otherwise penetrate varnish or other floor sealant that will prevent or retard the air and water movement. This step is not necessary however, and depends on conditions.

Next, the grid is laid on the floor. The grid is comprised of at least two planes, each plane comprised of generally parallel rows of strands of material, but each plane's rows being not parallel relative the rows of the adjacent plane. Each plane is also parallel to the plane of the floor to be dried. Thus, while a preferred embodiment will be described below, the essential feature of the grid is that it is configured such that air and water may pass between the two planes. Thus, for example, a grid that is uniplanar and is comprised of perpendicular strands which create cells, would generally not be appropriate as it would not permit the movement of air and water from the floor below the grid to the top of the grid.

Next, atop the grid is placed a special vacuum plate. On the top of the plate will be barbs that will penetrate the plastic sheeting or other membrane. The perimeter is then sealed with convenient sealing means, such as with 2" wide painter's tape. This type of tape is preferred as it will not harm the wood finish. If sanding is to be done, lesser expensive masking tape may be used.

The next step will be to set up a blower, such as an Injectidry HP 60 or 90, set on the suction side (negative pressure mode). Next, the tubes are connected from the standard blower to the barbs on the vacuum plates. When the system is thus set up, the blower is activated, and the covered floor area will begin drying. In appearance, the system will resemble a "shrink wrapped" floor section. Importantly, because of the configuration of the grid and the vacuum plate, the impermeable membrane such as visqueen, although taped or otherwise sealed around its perimeter, and compressed by negative pressure against the grid, will not prevent the migration of air or water from the floor, up through the two planes of the grid, into the vacuum plate and thence out through the tubes to the blower. While this system is effective at drying floors, it is also useful in removing excess moisture entrapped in fiberglass or wooden boat hulls.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
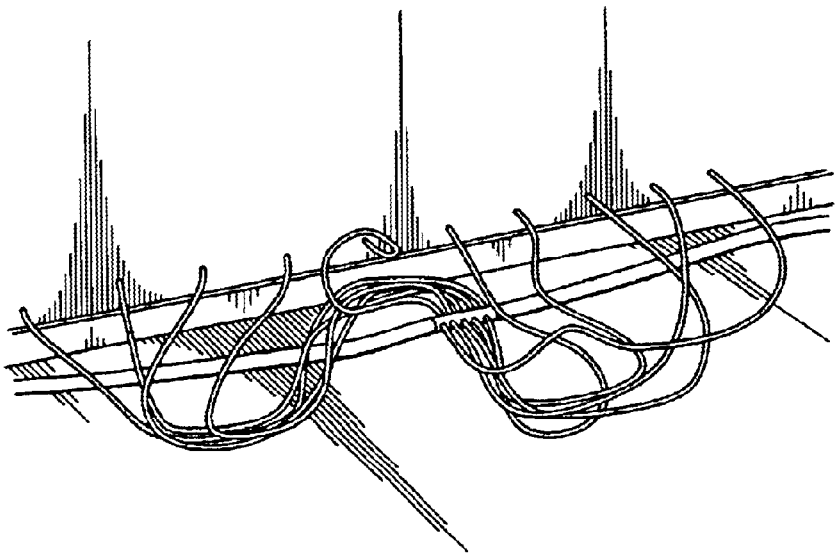
Fig. 1. (PRIOR ART)
FIG. 1 is an illustration of a prior configuration.

FIG. 1 is not an aspect of the present invention, but is useful in illustrating the configuration of my prior invention as set forth in U.S. patent application Ser. No. 08/890,141. It is also useful in understanding certain aspects and advantages of the active hoseline feature of present invention.

Figure 2:
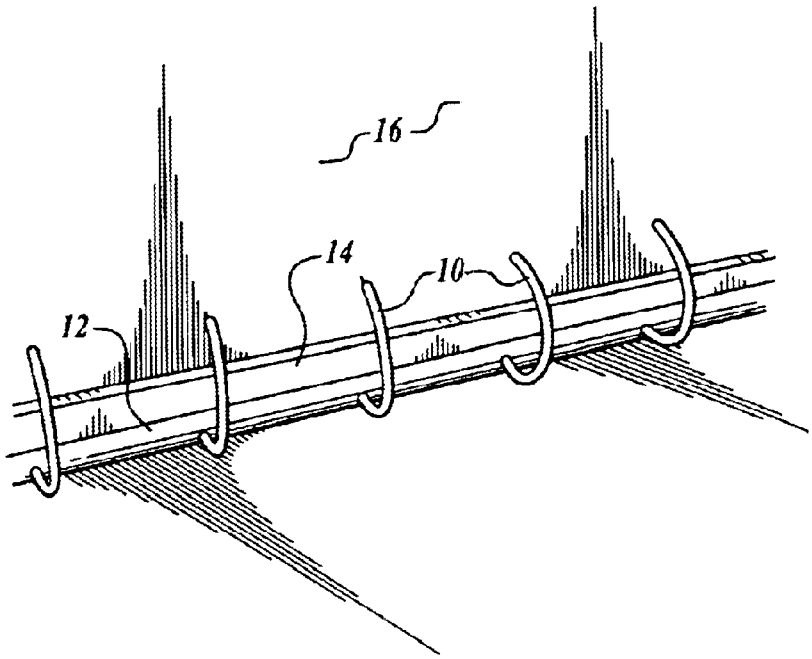
FIG. 2 is an illustration of the general configuration of the active hoseline feature of the present invention.

FIG. 2 does not show the details of the active hoseline feature of the present invention, but does illustrate the general configuration and context for the subsequent figures and description of the invention. It will be appreciated that while the tubes 10 of FIG. 2 are of uniform and short relatively short length, and uniform frequency along hose 12 for drying wall 16 just above baseboard 14, tubes 10 can be of any length, or of any frequency of distribution, regular or irregular, along hose 12. For example, in some applications it may be desirable for alternate tubes 10 to be long enough to reach a ceiling above the wall 16. In many applications, the preferred frequency of tube distribution along hose 12 will be 8 inches, such that two tubes 10 can be supplied between each wall cavity, such wall cavities (formed by studs within the wall) generally being approximately 16 inches wide along the length of wall 16.

Figure 3A:
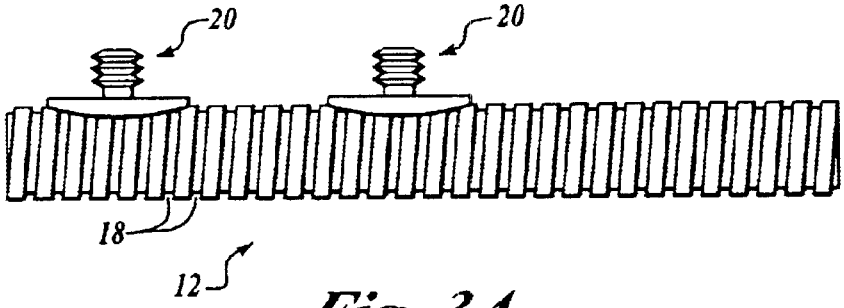
FIG. 3A is side view of the active hoseline feature of the invention, showing two inserts installed therein.

Referring now to FIG. 3, it will be seen in FIG. 3A that hose 12 will generally be corrugated or ribbed and thus have grooves 18 between each corrugation. Typically the corrugation will be spiral along the entire length of hose 12, but it need not be, and indeed the corrugation is only a typical feature of most hoses, but is not required for the practice of the invention. (Where the hose 12 is not corrugated, the means for preventing rotation of the insert 20 will differ from that described below). Hoseline 12 is penetrated in FIG. 3A by two inserts 20. Inserts 20 are for receiving and connecting to tubes 10 shown in FIG. 1 and as hereafter described.

Figure 3B:
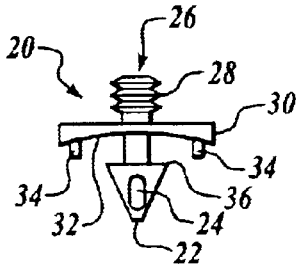
FIG. 3B is a cross sectional side view of the insert oriented 90 degrees from the view of FIG. 3A, or as seen from the perspective of viewing along the direction of the active hoseline.

FIG. 3B shows a cross section of insert 20 (typical). Insert 20 is comprised of a piercing point 22, an air scoop 24 adjacent the piercing point 22 and affixed to a hollow shaft 26. Circumferentially about hollow shaft 26 is a barbed nozzle 28 for insertion into tube 10 from FIG. 2. Between barbed nozzle 28 and air scoop 24 along and also circumferentially about hollow shaft 26 is a sealing flange 30 having a curved underside 32 and posts 34. Posts 34 are designed and configured to fit within grooves 18 of hose 12, so as to prevent rotation of insert 20 once inserted into hose 12. While a pair of opposing posts 34 are shown in FIG. 3B, it will be appreciated that only one such post 34, or any other number of such posts may be provided without departing from the spirit and scope of the invention. Similarly, if hose 12 is not corrugated, and thus lacks grooves 18, posts 34 may be sharper, shorter and more numerous than shown, and thereby prevent rotation by partially piercing the outer surface of hose 12, or may be prevented from rotation by suction, adhesive, friction or by any other means.

Curved underside 32 of sealing flange 30 has a curvature matching the curvature of the outside diameter of hose 12 so as to facilitate sealing to prevent air passage where insert 20 penetrates hose 12 (except of course through hollow shaft 26 as intended). While such curvature is advantageous, and is an inventive aspect, it will be appreciated that it need not be curved, and that such curvature is not essential to the practice of the invention. Similarly, in some applications adhesive may be used to facilitate a seal between insert 20 and hose 12, but adhesive is not required. For example, in the preferred embodiment, it is anticipated that air scoop 24 will have an inside sealing flange 36 opposite piercing point 22 that will seat against the inner diameter of hose 12 so as to provide a seal. In most embodiments, hose 12 will have a smooth curved surface, even if hose 12 is corrugated on the outside, such that a corresponding curvature may be supplied on inside sealing flange 36. However, it will be appreciated that the seal may be accomplished by any means, and that such corresponding curvature is not required to practice the invention, and that hose 12 may be of any type.

Figure 3C:
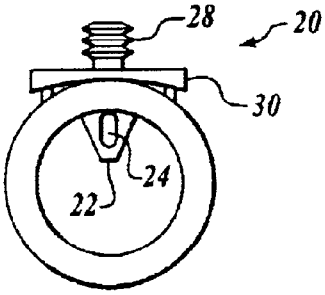
FIG. 3C is a cross section view of the insert inserted into the active hoseline, and oriented the same as FIG. 3B.

In the preferred embodiment, insert 20 is oriented such that air scoop 24 is facing toward the blower, or parallel with the air flow direction within hose 12. This orientation is shown in FIG. 3C, and will generally result in greater efficiency of the system. However, in alternate embodiments, alternate orientation may be desired. Note that FIG. 3C and FIG. 3B are oriented in the same way, and 90 degrees different from the orientation of FIG. 3A. Thus, in the depicted embodiment, posts 34 straddle part of the circumference of hose 12 at the same point along the length of hose 12. While this arrangement has certain advantages, it will be appreciated that post or posts 34 may be provided anywhere on curved underside 32, and may fit within any groove or grooves 18 in accordance with the invention. Furthermore, posts 18 may be eliminated altogether in applications where prevention of rotation of insert 20 is not required or desired. For example, in some applications it may be desirable to permit easy rotation of insert 20 to adjust the air flow captured or routed by air scoop 24. In most embodiments however, it will be desirable to prevent such rotation.

In the preferred embodiment, piercing point 22 will be sharp enough and hard enough enable puncturing and penetration of hose 12 simply by grasping insert 20 by hand and pushing it through hose 12. Such configuration eliminates the need for tools in the field when additional inserts are required or desired. However, it will be appreciated that in some applications it will be desirable to construct the insert with material or of a shape that will require tools for such penetration, without departing from the scope of the invention.

It will be appreciated that the length of hollow shaft 26 between curved underside 32 and sealing flange 36 will generally be the same as the thickness of the wall of hose 12, and perhaps slightly shorter so as to squeeze the hose somewhat for a superior seal.

In the depicted embodiment, it will be seen that sealing flange 36 is configured so as to prevent easy removal of the insert 20 from the hose 12. However, in some embodiments, it may be preferable to taper or curve sealing flange 36 so that removal is easier.

In the depicted embodiment, barbed nozzle 28 is barbed so as to facilitate a frictional seal between insert 20 and tubes 10 (not shown in FIG. 3, but shown in FIGS. 1 and 2.) However, it will be appreciated that barbed nozzle 28 need not be barbed as shown, nor even be sealed frictionally to to tube 10, but may be configured in any manner to facilitate a substantial seal between the tube 10 and the insert 20. Indeed, in some applications it may be preferable to not effect any such seal, but it is anticipated that a seal will generally be preferable.

Figure 3D:
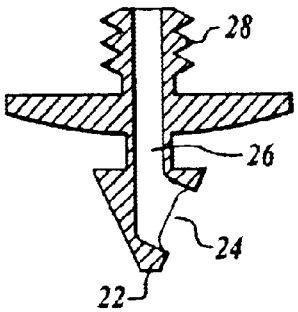
FIG. 3D is cross section view of the insert oriented the same as the inserts shown installed in FIG. 3A, and 90 degrees from that shown in FIGS. 3B and 3C.

FIG. 3D shows a cross-sectional side view of insert 20. The dotted lines therein depict the interior of hollow shaft 26, through which air passes in operation of the invention.

Figure 4A:
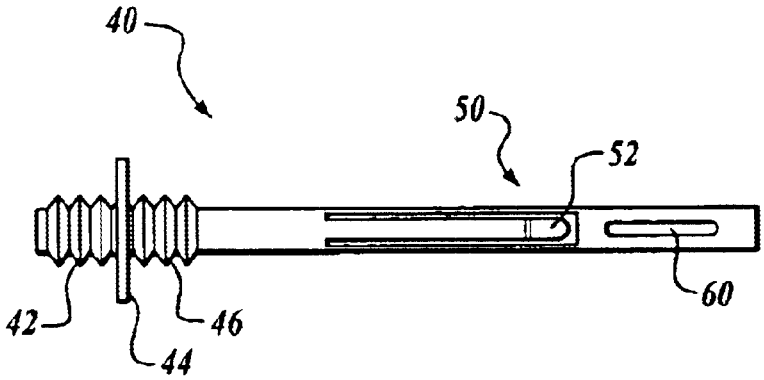
FIGS. 4A and 4B are side views, and cross section top views, respectively, of the improved injector feature of the invention.

FIG. 4 depicts the improved injector feature of the invention. FIG. 4A is a side view if improved injector 40. Injector 40 has a barbed nozzle 42 similar to the barbed nozzle 28 of FIG. 3. Thus, tubes 10 typically connect to barbed nozzle 28 of FIG. 3 on one end and barbed nozzle 42 of FIG. 4 on the other end. In this manner, dry air is blown from the blower through hose to the wet cavity through the tube 10 and injector 40 (in positive pressure mode), or conversely, wet air is sucked from the wet cavity through the injector 40 and tube 10 to the hose, and then to to the blower (in negative pressure mode). As with barbed nozzle 28, in the preferred embodiment barbed nozzle 42 may be configured in any manner to effect a substantial seal with tube 10.

Adjacent barbed nozzle 42 is a tube flange 44 for further facilitating a seal between tube 10 and injector 40. While tube flange 44 is a feature of the preferred embodiment, it will be appreciated that it is not required for the practice of the invention.

Adjacent tube flange 44 (or adjacent barbed nozzle 42 if a tube flange 44 is not used), is a barbed connector nozzle 46 for connecting another tube 10 to the injector when the injector 40 is used only as a connector, and not as an injector. That is, a feature of the improved injector 40 is that it can be used as a connector between tubes 10 as well as serving as an injector. This dual purpose or function of improved injector 40 is a significant improvement over prior systems. It facilitates improved versatility and convenience in the field. The connector mode may be useful, for example, when a longer tube is desired at a particular point along the hose. A second tube can simply be attached to the first one by slipping it over the injector 40, and seating it along the barbed connector nozzle 46.

Another inventive aspect of the improved injector 40 is the locking mechanism 50. Locking mechanism 50 is comprised of one or more flexible tabs 52, which, when compressed into injector 40, do not add any dimension to the diameter or outside width of injector 50, but when released, expand the effective diameter or outside width of injector 40 so as to retard or prevent unwanted withdrawal of injector 40 from the wall or ceiling (or other) hole into which it is inserted for drying of a wet structural cavity.

Figure 4B:
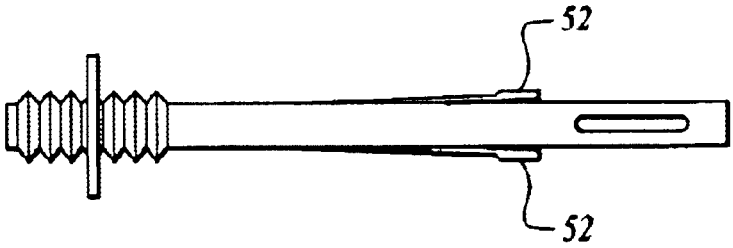

In the preferred embodiment, a pair of flexible tabs 52, as shown in FIG. 4B, are arranged opposite one another such that the user can easily grasp the pair between forefinger and thumb, and thereby insert the injector 40 into the hole in the structure enclosing the wet cavity to be dried. However, it will be appreciated that any number of flexible tabs (even merely one), can be used without departing from the spirit and scope of the invention. Similarly, while in the preferred embodiment the means for effecting the expansion of the tabs beyond the diameter or outside width of the injector 40 is the flexibility of the tabs, molded out of plastic to spring outward from the injector, it will be appreciated that the expansion may be accomplished by other means, such as with a spring. In any case, unlike present systems, the friction is effected behind the wall or ceiling (typically where aesthetics are not a concern), and the withdrawal prevention can be effected with a much smaller hole than otherwise. Moreover, unlike prior friction-based withdrawal prevention systems, the removal can be effected completely non-destructively, simply by squeezing the flexible tabs 52 together into the injector 40.

An additional inventive feature of the present invention is the improved means for preventing clogging or plugging. Referring again to FIG. 4A, it will be seen that injector 40 has at its end opposite barbed flange 42 a slot 60. Slot 60 is an improvement over prior systems in that it is less amenable to plugging than is the relief valve hole of prior systems designed to create a Bernoulli effect. Thus, in addition to a hole at the end of the injector (not shown), which is the means of prior systems to remove wet air or insert dry air, the present injector has a slot 60 along the side of the injector as an alternate route for the air to move should the end hole of the injector ever clog or plug.

While injector 40 is shown as being substantially straight, it will be appreciated that it may be slightly or substantially curved, as that may be desirable in certain applications, without departing from the spirit and scope of the invention.

In the currently preferred embodiment, injector 40 is approximately 2 inches in overall length, and approximately 3/16 inch in outside diameter on the injector end (that is, the end that is inserted into the wet cavity, as opposed to the barbed nozzle 42 end for receiving the tube 10). However, it will be appreciated that even smaller, or if desired, larger diameter injectors are possible. Similarly, while it is generally preferred that the injector 40 be generally tubular, that is round in cross sectional end view, it need not be so. It could be a square tube, triangular tube, octagonal tube, or any shape permitting the passage of air.

Floor Drying System

Figure 5A:
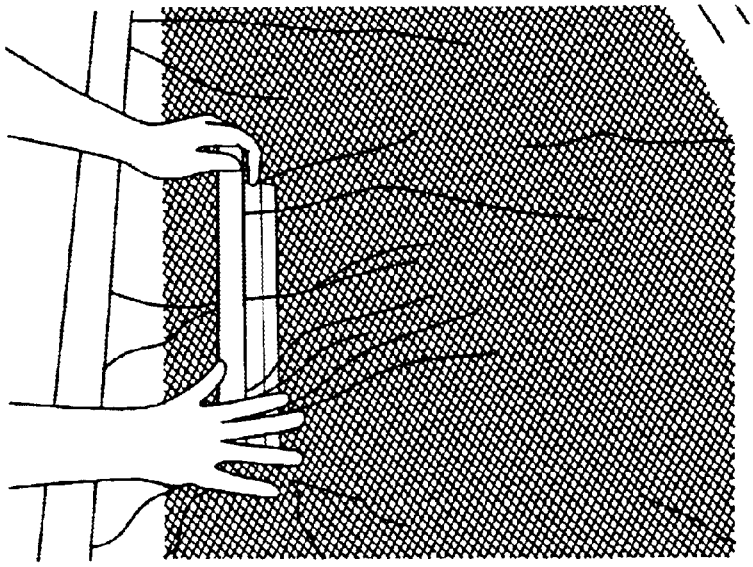
FIGS. 5A–5E are illiustrations of the floor drying system feature of the invention.
Figure 5B:
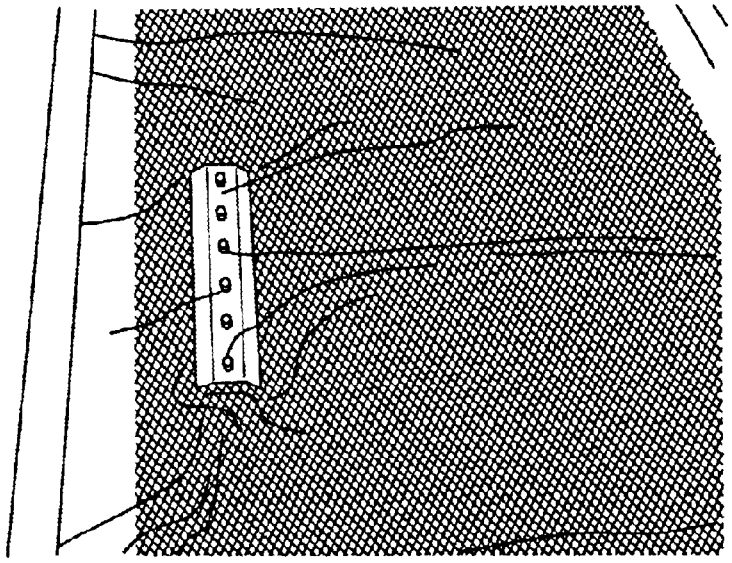
Figure 5C:
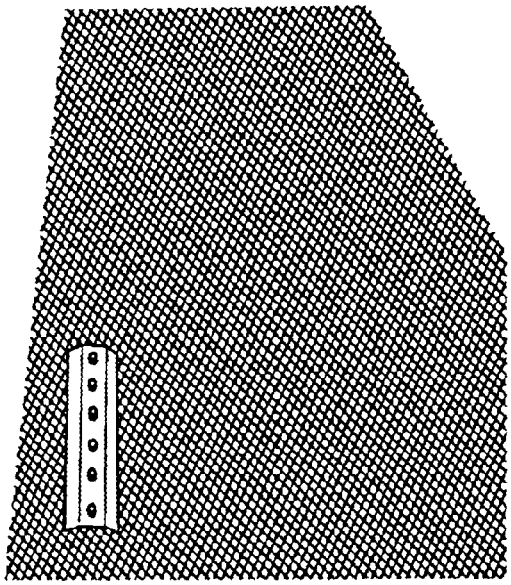
Figure 5D:
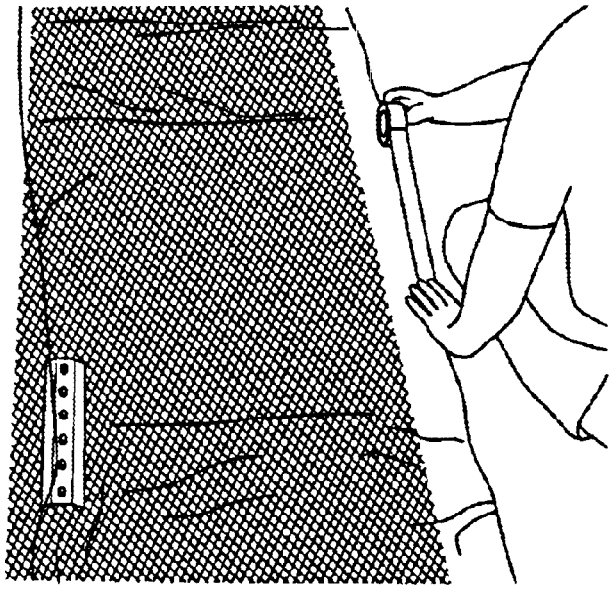
Figure 5E:
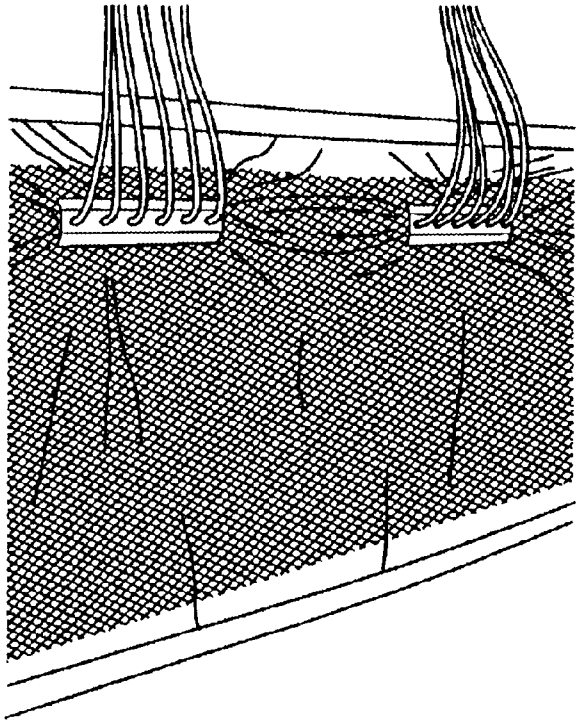

The floor drying aspect of the invention will now be described. While the previous aspects of the invention can be used to dry floors, the following aspect of the new system is particularly advantageous in drying floors, especially hardwood floors. Referring now to FIGS. 5A–5E, what is illustrated is the general method of the new system for drying floors, using the components described in greater detail in FIG. 6. Specifically, FIG. 5A shows the grid laid on the wet floor with a floor plate thereon, and both covered with the impermeable membrane. This membrane is sealed around its perimeter with tape, and is being pierced just above the barbed nozzles of the floor plate. FIG. 5B shows the membrane fitted neatly over the barbed nozzles of the floor plate. FIG. 5C shows two floor plates resting on the grid. FIG. 5D shows the tape being used to seal the membrane over the floor plate and grid. FIG. 5E shows tubes affixed to barbed nozzles of the floor plate, with the tubes off the page being connected to a manifold or hose to the blower, and illustrating the system ready to begin drying in negative pressure mode.

Referring now to FIG. 6, floor plate 70 (12 inch version shown) has a plurality of barbed nozzles 72 for receiving tubing from the hose and blower system previously described. Floor plate 70 is shown in end view in FIG. 6B. Floor plate 70 has side walls 74 which raise floor plate off of the grid by a dimension 76. Dimension 76 is anticipated to be approximately ½ inch, but can be any dimension sufficient to permit air to pass under floor plate 70 and out through barbed nozzles 72 (which are hollow, and connect with tubes 10 as do barbed nozzles 28 and 42 previously described).

Figure 6A:
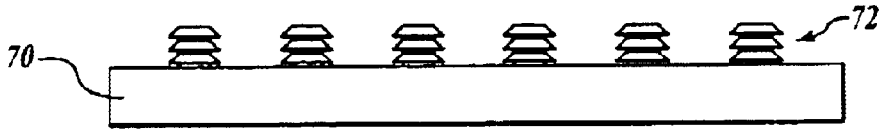
FIGS. 6A and 6B are side and end views, respectively, of the floor plate of the floor drying aspect of the invention.
Figure 6B:
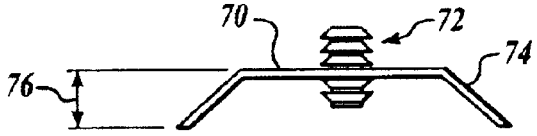
Figure 6C:
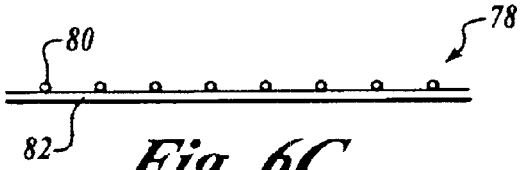
FIG. 6C is a cross-sectional detail of the grid of the floor drying aspect of the invention.
Figure 6D:
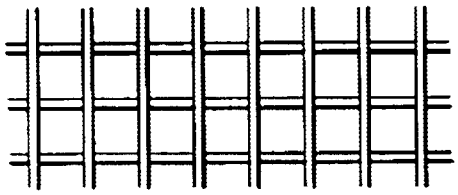
FIG. 6D is a top-view detail of a section of the same grid.

Floor plate 70 depicted in FIGS. 5A–5E, and in FIGS. 6A and 6B, rests upon the grid 78 shown in FIGS. 6C and 6D. Grid 78 is comprised of roughly parallel upper strands 80 in one plane superimposed over another set of roughly parallel lower strands 82 in a lower plane. While the strands 82 are roughly parallel with other strands 82, and the strands 80 are roughly parallel with the other strands 80, strands 80 and 82 are not parallel with each other such that, as shown in FIG. 6D, a lattice-work type formation is created. The precise angle of orientation of the strands 80 and 82 relative to each other is not critical. All that is critical for this aspect of the invention is that air and moisture are able to pass from one plane to the other. That is, the purpose of grid 78 is to provide a space between the impermeable membrane (not shown) which is laid over the grid and the wet floor through which air and moisture may pass, even when the negative pressure is exerted against the membrane. (In positive pressure mode, no grid is required, but more care must be taken that the perimeter is sealed).

Now that the details of the particular components of the floor drying system have been described, a general description of the use of the system is provided. Reference to FIGS. 5A–5E may again be helpful here.

In the preferred embodiment, the grid 78 is either 300 square feet (in the 60 Pak) and 450 square feet (in the 90 Pak). This grid is 30 inches wide. To make handling easier, one way to use it is to cut it into 3 foot long pieces. When covering a wet area with the grid, the user simply places on the floor enough pieces to cover the affected area to be dried. The grid is irregular enough to allow air and moisture to travel up vertically and then horizontally as there is not a perfect seal between the grid and the floor surface.

In the preferred method of use, painter's tape is specified as it will not remove finish from the floor when removed. Three or four mil plastic sheeting is recommended as the impermeable membrane because of its ease of handing and use. It is also tough enough to allow foot traffic when system setup is completed.

Floors that can be effectively dried include hardwood, plaster walls with wet door headers, quarry tile, marble, and other surfaces that include grout which can allow moisture to penetrate beneath the surface.

The mechanics and steps are as follows:

Apply special grid 78 to the wet area. This is an irregular grid designed to let moisture and air travel vertically and horizontally between two sealing surfaces. The one surface obviously is the hardwood and the next covering layer will be 3–4 mil plastic sheeting.

Apply a special vacuum plate 70 on top of the grid. On the top of the plate will be barbed nozzles 72 that will penetrate the plastic sheeting.

The perimeter will be sealed with 2" wide painter's tape. This type of tape is preferred as it will not harm the wood finish. If sanding is to be done, lesser expensive masking tape may be used.

The next step will be to set up blowers such as an Injectidry HP 60 or 90 set on the suction side (negative pressure mode). Next, connect the tubes from the standard Injectidry manifolds to the barbed nozzles 72 on the floor plates 70. When the system is set up, turn on the HP drying system and the floor will be appear to be "shrink wrapped".

In the preferred method of use, some of the finish should be removed prior to drying, using a 3M® type floor stripping pads disk beneath a buffer or use fine sandpaper taking care to not take off more than just a little of the finish. No preparatory aggressive sanding should be done unless sanding and refinishing are to be done on completion. If you do not remove some of the finish, however, the drying may not occur very quickly.

The subfloor must be dried for effective results. If there is a crawlspace, inspect, pull down wet insulation and dry using air movement and dehumidification. If moisture is not removed to equilibrium, the would floor will most likely gain this excess moisture and cup. If the underside is a finished room, a second HP 60 or 90 can be set up to dry through the ceiling. This will dry the subfloor. Moisture readings of all surface material including subfloor will be the only way to determine dry. In preferred usage, jobs should be monitored daily. Some jobs can literally dry overnight, especially if finish is removed, and over-drying can damage the floor.

While the preferred usage is for hardwoods, other floors such as tile, slate floors, concrete and other semi-permeable hard surfaces can be dried using the system. Summary of steps in the preferred method of the system:

Step 1: Determine the area that has elevated moisture content.

Step 2: Might include the initial partial removal of finish in selected areas by light sanding or chemical stripping.

Step 3: Place the grid over the damp area.

Step 4: Place a floor plate over the grid out of the traffic area.

Step 5: Place 3 or 4 mil visqueen over the wet area and over the grid and plate (such a Vac-It Plate® available from Injectidry®).

Step 6: Seal around the edges with tape. If no sanding is anticipated, releasable painters tape should be used. Otherwise, masking tape may be used. This will seal the visqueen to the surface to be treated.

Step 7: Connect tubes to Vac-It Plate and connect tubing to vacuum means.

Step 8: Apply vacuum.

Step 9: Monitor and stop drying when equilibrium is reached.

Step 10: Remove grid and evaluate for any further work.

Objective is to remove moisture faster than the standard method of letting the wet material dry out naturally, or by merely blowing air over the surface, or by puncturing the floor with holes. Further objective is to provide lower pressure point to induce moisture to move toward lower pressure.

The basic components of the system in its preferred embodiment include:

Irregular extruded grid to allow air and moisture to move vertically and laterally between two surfaces, one flat and firm and the other conforming to grid surface (e.g. visqueen).

Vacuum plate that is tunnel shaped that conforms to grid, sealable with the visqueen. Plate is to have vacuum attachment points Vacuum means of 40+ inches of water lift Plastic sealing such as 4 mil visqueen While the preferred embodiment of most of the components of the described system will be constructed of plastic, it may be made of many materials known to those of ordinary skill in the art.

The foregoing embodiment is merely illustrative of the use or implementation of but one of several variations or embodiments of the invention. While a preferred embodiment of the invention has been illustrated and described with reference to preferred embodiments thereof, it will be appreciated that various changes can be made therein without departing from the spirit and scope of the invention.

For example, while the system contemplates that the inserts in the active hoseline may be added by users at will, it is contemplated that the preferred embodiment will be sold as a completely pre-configured system, such that no inserts need to be installed by the user, and that the inserts will be essentially permanent for durability.

While the preferred embodiment contemplates that the inserts may be inserted easily by hand, in some applications it may be preferable that insertion and/or removal of the inserts will require tools. Also, in the preferred embodiment, it is anticipated that the removal of the insert will not leave a hole in the hose, but that the hole into which it was place previously will essentially reseal upon removal of the insert.

In the preferred embodiment, the inserts for the tubes will be spaced every eight inches. However any frequency, regular or irregular, may be practiced without departing from the invention. Similarly, in the preferred embodiment, hoses will come in ten foot standard lengths. However, any length of hose may be provided, as well as any length of tube. An advantage of the invention is that manifolds (such as that of my prior system) are not required. However, a manifold may still be used with the invention.

The invention may be practiced with the hoses terminating, or a forming a complete circuit back to the blower, and with any number of blowers. Similarly, either positive or negative pressure may be used with the system. This decision will be dictated by conditions or goals.

I claim:

1. A moisture removal device for drying a structure, the moisture removal device comprising:

a blower;

a flexible hose having an internal channel, a first end and a second end, the first end connected to the blower, the second end closed;

a hose insert having a piercing protrusion with an orifice, a hollow shaft continuous with the orifice, and a coupler continuous with the hollow shaft, such that when the piercing protrusion is pressed against the flexible hose, the piercing protrusion penetrates through the flexible hose and places the orifice into the internal channel of the flexible hose;

an injector with an open end inserted into the structure, a hollow channel continuous with the open end, and a connector continuous with the hollow channel; and a flexible tube with a first end removably connected to the coupler of the hose insert, and a second end removably connected to the connector of the injector, whereupon operation of the blower causes removal of moisture from the structure.

2. The device of claim 1, wherein the blower is a positive pressure device forcing air to flow from the flexible hose and to the injector.

3. The device of claim 1, wherein the blower is a negative pressure device forcing air to flow from the injector and to the flexible hose.

4. The device of claim 1, wherein the flexible hose has a sufficient length to receive a plurality of hose inserts, each insert sufficiently spaced to function as a manifold.

5. The device of claim 1, wherein the hose insert has a ceiling flange, the ceiling flange having a plurality of posts, the plurality of posts serving to hold the hose insert in position on the flexible hose.

6. The device on claim 1, wherein the piercing protrusion further includes an airscoop continuous with the hollow shaft, the airscoop serving to convey airflow between the internal channel of the flexible hose, through the hollow shaft, and to the flexible tube.

7. The device of claim 1, wherein the injector is secured to the structure using a biased tab having at least one retainment protrusion.

8. A moisture removal device for drying a structure, the moisture removal device comprising:

a blower;

a flexible hose having an internal channel, a first end and a second end, the first end connected to the blower, the second end closed;

a plurality of hose inserts, each insert having means to attach and convey airflow from the interior of the flexible hose to the exterior of the hose insert;

a plurality of connection hoses, each connection hose having a first end and a second end, the first end of each connection hose attached to each hose insert, respectively; and a plurality of injectors, each injector having a first end and a second end, the first end of the injector being connected to the second end of the connecting hose and the second end of each injector being inserted into the structure, such that air flows between the blower and the plurality of injectors.

9. The device of claim 8, wherein each hose insert includes a piercing protrusion, the piercing protrusion having a coaxial channel to convey air, the piercing protrusion serving to penetrate the hose, and a flange for the securing the hose insert to the hose.

10. The device of claim 9, wherein the piercing point has an airscoop continuous with the coaxial channel.

11. The device of claim 9, wherein the flange has a curvature substantially matching the curvature of the outside diameter of the flexible hose to facilitate sealing to prevent air losses to the exterior of the flexible hose.

12. The device of claim 9, wherein the flange includes a plurality of posts, each post serving to anchor the hose insert to the flexible hose to restrain rotation about the flexible hose.

13. The device of claim 9, wherein the hose insert further includes an interior flange to facilitate sealing to prevent air leakage around the outer portion of the piercing protrusion.

* * * * *